US006736267B2

(12) United States Patent
Schamante

(10) Patent No.: US 6,736,267 B2
(45) Date of Patent: May 18, 2004

(54) DISPLAY CARD HAVING REINFORCED HANGER HOLE

(76) Inventor: John A. Schamante, 2521 Torquay Ave., Royal Oak, MI (US) 48073

( * ) Notice: Subject to any disclaimer, the term of this patent is extended or adjusted under 35 U.S.C. 154(b) by 77 days.

(21) Appl. No.: 10/152,925

(22) Filed: May 21, 2002

(65) Prior Publication Data

US 2003/0217949 A1 Nov. 27, 2003

(51) Int. Cl.[7] ..... B65D 85/88
(52) U.S. Cl. ..... 206/705; 206/703
(58) Field of Search ..... 206/461, 469, 206/470, 471, 703, 705; 383/17, 20

(56) References Cited

U.S. PATENT DOCUMENTS 2,983,087 A * 5/1961 Schofield
4,682,447 A * 7/1987 Osborn
4,764,028 A * 8/1988 Wood et al.
4,948,267 A * 8/1990 Kaldenbaugh
6,308,832 B1 * 10/2001 Pirro et al.
6,364,115 B1 * 4/2002 Casanova et al.
2001/0052478 A1 * 12/2001 Casanova et al.

* cited by examiner

*Primary Examiner*—David T. Fidei
(74) *Attorney, Agent, or Firm*—Gifford, Krass, Groh, Sprinkle, Anderson & Citkowski, P.C.

(57) ABSTRACT

A product display package for retaining product is provided with a display card having a reinforced hanger hole that is resistant to tear. The display card includes a main body including a front surface, a rear surface and an upper edge. The display card has a closed loop hanger hole formed in the main body that is adapted to receive a hanger to hang the display card for display. A container having a housing defining a compartment to house product is supported by the display card. The display card has a tape reinforcement layer adhered to the main body in a region adjacent to the hanger hole to enhance the strength of the display card between the hanger hole and the upper edge of the main body of the display card.

29 Claims, 2 Drawing Sheets

DISPLAY CARD HAVING REINFORCED HANGER HOLE

BACKGROUND OF THE INVENTION

The present invention generally relates to display cards for displaying products for sale and, more particularly, to a hanging display card package having a combined display card and container for retaining product for display to consumers.

A common practice for packaging and displaying small retail items, such as cylindrical alkaline batteries, is to package the items in thermoformed blister packages and place the packages on shelves or hang the packages on hooks on various display racks. Conventional battery packages are generally composed of a display card which provides a generally stiff supportive backing, usually composed of cardboard, and a thermoformed polymeric blister that is bonded or otherwise attached to the display card. The display card provides support for displaying the merchandise for sale and usually contains print with suitable indicia, such as advertising, trademarks, and instructions.

With battery display packages, batteries of the same size are commonly made available to consumers for purchase in a package containing a predetermined number of batteries. The batteries are displayed and sold in blister-type packages which usually contain two, four, or eight batteries commonly packaged in each display package. In accordance with one battery packaging approach, the thermoformed blister generally comprises a piece of transparent polymeric material, e.g., plastic, heat-sealed to the front side of the display card. According to another approach, a clam-type thermoformed polymeric blister, generally having a shape to fit over and cover the batteries, is supported on the cardboard display card. The clam-type polymeric blister typically has two pieces, each having a peripheral flange disposed between the two layers of the cardboard of the display card. The blister isolates the product from the surrounding environment and prevents inadvertent damage to the product that can result from repeated handling prior to sale. Additionally, the blister allows for the orderly display of products for sale to purchasers.

Hanging display packages generally include a closed loop hanger hole formed in the display card near the upper edge. The hanger hole enables the package to be hung on a hanger, such as a hook, on a display stand for display to consumers in a retail store. The hanger hole is formed by cutting (e.g., stamping) away a piece of card material from the cardboard display card in a shape sufficient to receive the hanger. It is generally preferred that the hanger hole be located as close to the upper edge as possible, so as not to interfere with the surface area available on the display card for displaying print indicia and retaining product. However, a sufficient amount of the card material must be present between the hanger hole and the upper edge of the display card to provide adequate strength to support the package on the hanger and prevent tearing of the display card. A tear in the display card may render the display package unhangable on the display stand and torn display cards are generally unattractive to consumers, thus rendering the package less desirable. The potential for torn display cards increases with heavier packages, shortened distance between the hanger hole and upper edge, and misuse by retail customers or store clerks.

Accordingly, there is a need, heretofore unfulfilled, for a hanging product display package for displaying product for sale to consumers having a display card that provides a hanger hole of sufficient strength to hold the product on a display stand without tearing the display card. In particular, it is desirable to provide for such a hanging product display package that retains batteries for display and sale to consumers in retail stores.

SUMMARY OF THE INVENTION

The present invention provides for a display card and product display package having a reinforced hanger hole that is resistant to tearing. To achieve this and other advantages, and in accordance with the purpose of the present invention as embodied and described herein, one aspect of the present invention provides for a display card for retaining product. The display card includes a main body including a front surface, a rear surface, and an edge. The display card has a closed loop hanger hole formed in the main body that is adapted to receive a hanger to hang the display card for display. The display card also has a tape reinforcement layer adhered to the main body in a region adjacent to the hanger hole to enhance the strength of the display card between the hanger hole and the edge of the main body.

According to another aspect of the present invention, a display package for retaining product is provided. The display package comprises a container having a housing defining a compartment adapted to house product. The display package also has a display card having a main body and supporting the container. The display card has a front surface, a rear surface, and an edge. The display package further has a closed loop hanger hole formed in the display card for allowing the display package to be hung from a hanger for display. A tape reinforcement layer is adhered to the display card in a region adjacent to the hanger hole to provide reinforced strength between the hanger hole and the edge of the display card.

Accordingly, the tape reinforcement layer advantageously enhances the strength of the region adjacent to the hanger hole. The enhanced strength region adjacent to the hanger hole prevents tearing of the display card, particularly during abusive handling of the display package. Accordingly, a more attractive product display package is maintained, which is particularly useful for displaying small items, such as batteries, for display to consumers in retail stores.

These and other features, advantages and objects of the present invention will be further understood and appreciated by those skilled in the art by reference to the following specification, claims and appended drawings.

DETAILED DESCRIPTION OF THE PREFERRED EMBODIMENTS

Figure 1:
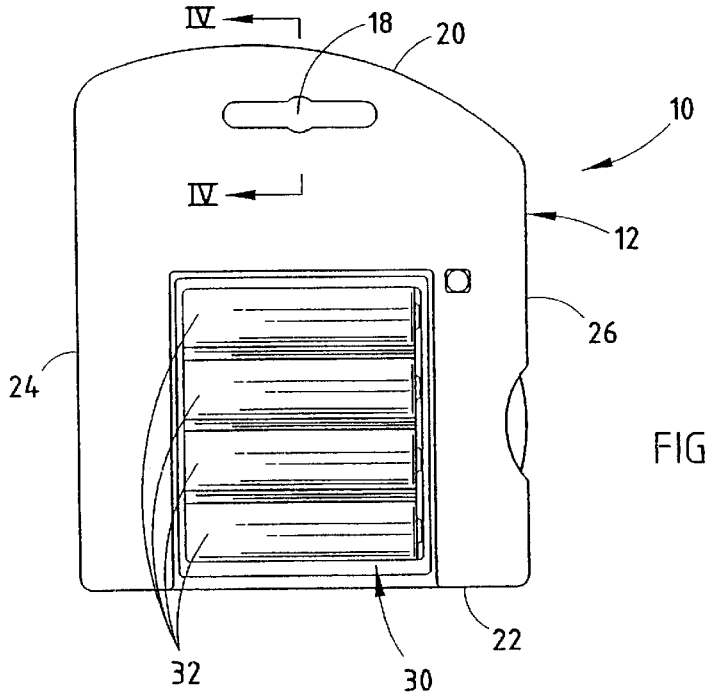
FIG. 1 is a front view of a battery display package having a reinforced hanger hole according to one embodiment of the present invention.
Figure 5:
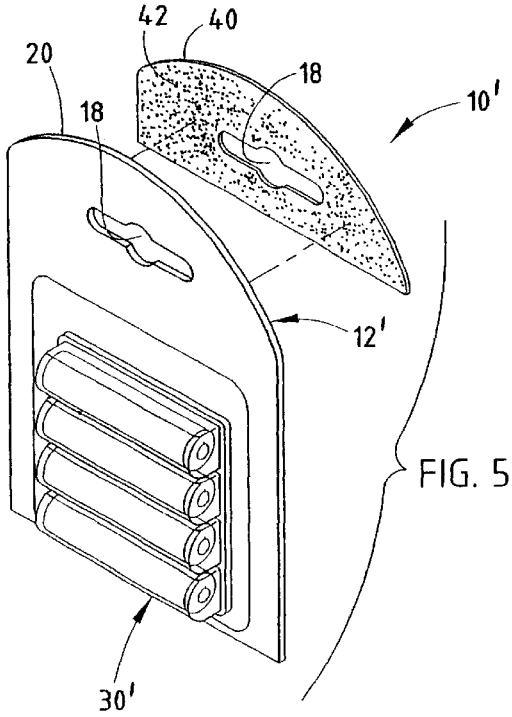
FIG. 5 is a front perspective view of a battery display package having a reinforced hanger hole shown in a partial exploded view according to a second embodiment of the present invention.

For purposes of description herein, the terms "upper," "lower," "right," "left," "rear," "front," "vertical," "horizontal" and derivatives thereof shall relate to the invention as oriented in FIGS. 1 and 5. However, it is to be understood that the invention may assume various alternative orientations and step sequences except where expressly specified to the contrary. It is also to be understood that the specific packages illustrated in the attached drawings, and described in the following specification, are simply exemplary embodiments of the inventive concepts defined in the appended claims. Hence, specific dimensions and physical characteristics relating to the embodiments disclosed herein are not to be considered as limiting, unless the claims expressly state otherwise.

Figure 2:
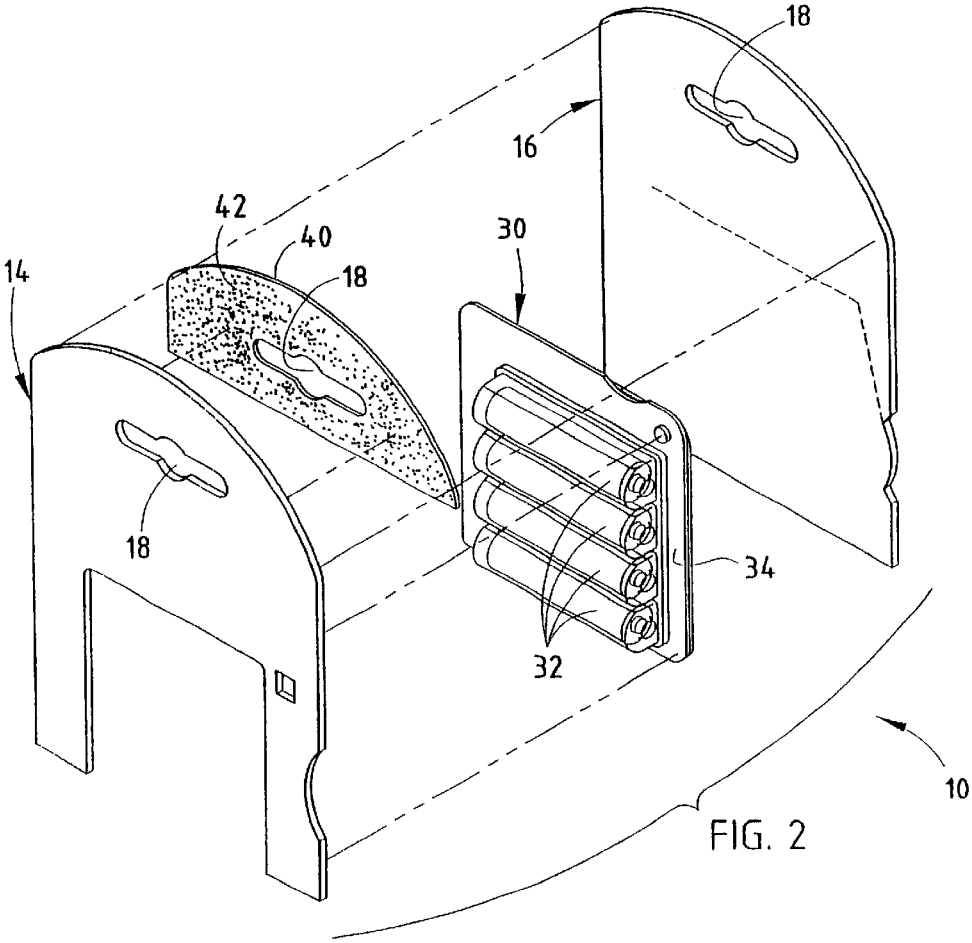
FIG. 2 is an exploded view of the battery display package shown in FIG. 1.

Referring to FIGS. 1 and 2, a hanging product display package 10 is shown for packaging a plurality of cylindrical batteries, such as AA-sized alkaline batteries for display and sale to consumers in a retail store, according to a first embodiment. The product display package 10 houses four cylindrical AA-size batteries, according to one example, in a combination display card and merchandise container. While a battery display package 10 is shown and described herein, it should be appreciated that the present invention provides a product display package that may house products of various sizes, shapes, and numbers, which may include batteries or other types of products, without departing from the spirit of the present invention.

The product display package 10 generally includes a display card 12 have a substantially planar main body, and a polymeric blister merchandise container 30 supported by the display card 12. The display card 12 is shown made up of two layers of materials, including a front layer of cardboard 14 attached to a rear layer of cardboard 16. Cardboard layers 14 and 16 may include two separate sheets of cardboard substantially similarly shaped and bonded together via glue. Alternately, layers 14 and 16 may be formed from a single sheet of cardboard that is folded along one edge, such as the lower edge, and pressed and bonded together. Display card 12 generally includes an upper edge 20, two vertical side edges 24 and 26 on the left and right sides, respectively, and a lower edge 22. The upper edge 20 of display card 12 is shown having an asymmetric shape relative to a central vertical axis in that the upper edge 20 extends to a position that is lower on the right vertical edge 26 as compared to the left vertical edge 24.

Provided near the upper edge 20 of display card 12 is a closed loop hanger hole (aperture) 18 which allows the display card 12 to be hung from a hanger, such as a hook, on a display stand. The hanger hole 18 is spaced below the upper edge 20, but is preferably formed as close as possible to the upper edge 20 so as to maximize the amount of surface area available therebelow on the display card 12 that may be used to retain product and contain print indicia such as advertising, trademarks, and instructions. The closed loop hanger hole 18 is completely surrounded by and defined by the display card 12 such that the hole is spaced apart the upper edge 20. While the hanger hole 18 is shown having a horizontal slot with an enlarged circular region in the center, it should be appreciated that the hanger hole 18 may be configured in various shapes and sizes.

The merchandise container 30 that is shown in the first embodiment is a reclosable and reusable transparent thermoformed blister container that houses four cylindrical batteries 32. The merchandise container 30 has a peripheral flange 34 formed around the perimeter of the compartment containing product and extending radially outward. The peripheral flange 34 is sandwiched between the front and rear layers 14 and 16, respectively, of display card 12. Merchandise container 30 extends through a cut out (e.g., aperture) formed in the front layer of display card 12. The merchandise container 30 is preferably bonded or trapped in place between the front and rear layers 14 and 16 of display card 12 prior to the display card 12 being torn open.

Figure 3:
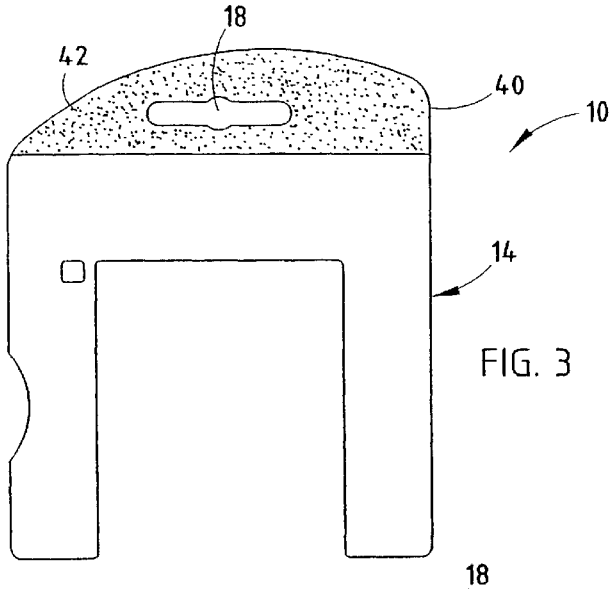
FIG. 3 is a rear view of the front layer of the display card.

The display card 12 of the present invention includes a tape reinforcement layer 40 adhered via adhesive 42 to the display card 12 in a local region adjacent to the hanger hole 18 to provide enhanced strength between the hanger hole 18 and the upper edge 20 of the display card 12. As is shown in FIG. 3, the tape reinforcement layer 40 is adhered to a rear surface of the front layer 14 of the display card 12. Accordingly, the tape reinforcement layer 40 is sandwiched between the front and rear layers 14 and 16 of display card 12. According to this embodiment, the tape reinforcement layer 40 is hidden from view of consumers and does not interfere with external viewable space on the display card 12 that may otherwise be employed to contain print indicia. The tape reinforcement layer 40 is preferably adhered to a surface of the display card 12 by any suitable adhesive 42, such as conventional glue and heat activated adhesives. While the tape reinforcement layer 40 is shown adhered to a rear surface of the front layer 14 of display card 12, it should be appreciated that the tape reinforcement layer 40 may instead be adhered to the front surface of the rear layer 16 of display card 12, or may be adhered to both the rear surface of the front layer 14 and the front surface of the rear layer 16 of display card 12. Alternately, the tape reinforcement layer 40 may be adhered to the rear surface of the rear layer 16 or the front surface of the front layer 14 of display card 12.

The tape reinforcement layer 40 may include a polypropylene film tape, such as 230 polypropylene, adhered via an adhesive 42 such as emulsion acrylic. According to one example, the polypropylene film has a thickness of 1.9 mils and the emulsion acrylic has a thickness of 1.0 mil. Another example of tape reinforcement layer 40 includes polyester film, such as Mylar® which is commercially made available by E. I. duPont De Nemours and Company. The tape reinforcement layer 40 may alternately employ a fiber reinforced strip of material. The thickness of the display card 12 is substantially greater than the thickness of the tape reinforcement layer 40. The tape reinforcement layer 40 preferably has a thickness of no greater than twenty-five (25%) percent of the thickness of the display card 12.

According to one embodiment, the battery display package 10 is manufactured by starting with a sheet of cardboard material. Prior to cutting out the individual display cards from the starting sheet, a strip of reinforcement tape is adhered across the sheet of cardboard material. The front layer 14 of display card 12 is then cut from the sheet with a punch to form the shape of the upper and lower edges and the left and right edges. At the same time, the strip of reinforcement tape is also cut to the shape as shown which is located so as to surround the closed loop hanger hole 18 and be between, and preferably adjacent to, the hanger hole 18 and the upper edge 20, as well as upper portions of the left and right edges of display card 12. The rear layer 16 of display card 12 is also cut from a sheet of cardboard material. The merchandise container 30, containing product, is sandwiched between front and rear layers 14 and 16, and layers 14 and 16 are glued or otherwise adhered together. The hanger hole 18 is formed by cutting out a piece of card material from each of front and rear layers 14 and 16 and tape reinforcement layer 40.

Figure 4:
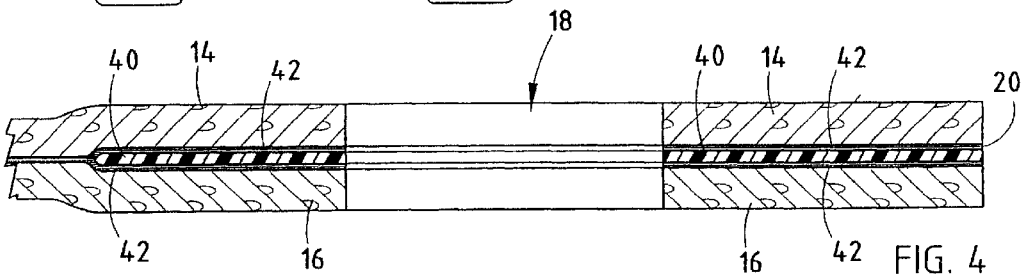
FIG. 4 is an enlarged cross-sectional view taken through lines IV—IV of FIG. 1.

Referring to FIG. 4, the tape reinforcement layer 40 is shown adhered to both the front and rear layers 14 and 16 of display card 12. It should be appreciated that the front and rear layers 14 and 16 of display card 12 are adhered together via adhesive layer 42, which may include a heat activated adhesive. In addition, adhesive 42 is disposed between the rear surface of front layer 14 and tape reinforcement layer 40, as well as between the front surface of rear layer 16 and tape reinforcement layer 40. The tape reinforcement layer 40 may be first adhered to the rear surface of the front layer 14, and thereafter the front surface of the rear card 16 is adhered, via a heat activated adhesive, to the rear surface of the front card 14.

Accordingly, the product display package 10 of the first embodiment employs a tape reinforcement layer 40 disposed between front and rear layers 14 and 16 of display card 12, which advantageously makes the tape reinforcement layer 40 hidden from view of consumers. As a consequence, more external viewable surface space is made available for print indicia.

Figure 6:
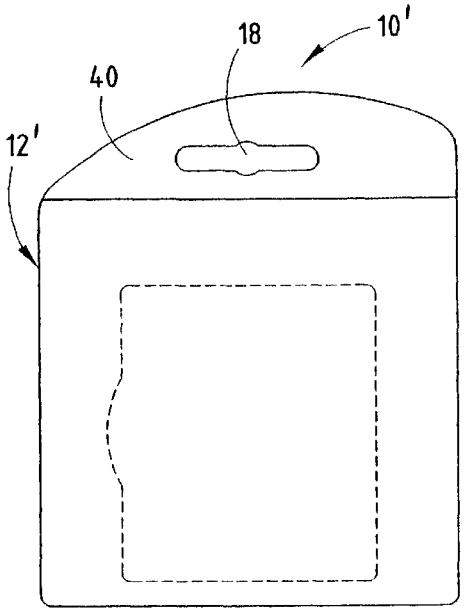
FIG. 6 is a rear view of the display package shown in FIG. 5.

Referring to FIGS. 5 and 6, a battery display package 10' is shown according to a second embodiment of the present invention. The battery display package 10' employs a single layer display card 12' having a thermoformed blister merchandise container 30' heat-sealed or otherwise bonded to the front surface of display card 12'. As a consequence, the merchandise container 30' traps product(s), such as cylindrical alkaline batteries 32, between the merchandise container 30' and the front surface of the display card 12'. Accordingly, the merchandise container 30' forms a compartment for holding product(s), and the container 30' and product(s) are retained by the display card 12'.

The battery display package 10' further includes a closed loop hanger hole 18 displaced below the upper edge 20 of display card 12' for receiving a hanger, such as a hook, for hanging the battery display package 10' from a display stand. A tape reinforcement layer 40 is adhered to the rear surface of the display card 12'. The hanger hole 18 and tape reinforcement layer 40 may include the hanger hole and tape reinforcement layer as discussed in connection with the first embodiment. According to the second embodiment, the tape reinforcement layer 40 remains visible to consumers on the back surface of the single layer display card 12'. The tape reinforcement layer 40 is provided in a region adjacent to the hanger hole 18 and between the hanger hole 18 and upper edge 20 of display card 12' so as to provide enhanced strength to the region surrounding the hanger hole 18 and prevent tearing between the upper edge 20 and hanger hole 18. Consequently, the battery package 10' is less susceptible to tearing which may otherwise occur due to abusive handling of the package 10'.

According to one example, the merchandise container 30 of package 10 according to the first embodiment is preferably made of a polymeric thermoformed blister. The individual front and rear layers 14 and 16 of display card 12 each have a thickness of approximately 16–24 mils. The tape reinforcement layer 40 preferably has a thickness of about 2 mils for a polypropylene film, and each adhesive layer has a thickness of about 1 mil. According to another example, the display card 12 of package 10 according to the second embodiment has a thickness in the range of approximately 24–28 mils, the tape reinforcement layer 40 preferably has a thickness of about 2 mils for a polypropylene film, and the adhesive layer has a thickness of about 1 mil.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

What is claimed is:

1. A display card adapted to hang from a hanger and retain product, said display card comprising:

a main body adapted to retain product and including a front surface, a rear surface, and an edge;

a closed loop hanger hole formed in said main body and adapted to receive a hanger to hang the display card;

a tape reinforcement layer adhered to the main body in a region adjacent to the hanger hole to enhance the strength of the main body between the hanger hole and the edge of the main body of the display card; and a container having a housing defining a compartment adapted to house product, said container being supported by the main body of the display card.

2. The display card as defined in claim 1, wherein said main body comprises a first layer of material attached to a second layer of material, and said tape reinforcement layer is adhered to one of said first and second layers of material.

3. The display card as defined in claim 2, wherein said tape reinforcement layer is disposed between said first and second layers of material.

4. The display card as defined in claim 1, wherein said tape reinforcement layer comprises a polypropylene film.

5. The display card as defined in claim 1, wherein the main body has a thickness substantially greater than a thickness of the tape reinforcement layer.

6. The display card as defined in claim 5, wherein said tape reinforcement layer has a thickness no greater than twenty-five percent of the thickness of the main body.

7. The display card as defined in claim 1 further comprising an adhesive located between the tape reinforcement layer and the main body for adhering the tape reinforcement layer to the main body.

8. The display card as defined in claim 1, wherein said container comprises a thermoformed blister of polymeric material.

9. The display card as defined in claim 1, wherein said display card comprises cardboard.

10. The display card as defined in claim 1, wherein said display card retains one or more batteries.

11. A display package adapted to hang from a hanger and retain product, said display package comprising:

a container having a housing defining a compartment that is adapted to house product;

a display card having a main body and supporting said container, said display card having a front surface, a rear surface, and an edge;

a closed loop hanger hole formed in the display card for allowing the display package to hang from a hanger; and a tape reinforcement layer adhered to the display card in a region adjacent to the hanger hole to provide reinforced strength between the hanger hole and the edge of the display card.

12. The display package as defined in claim 11, wherein said display card comprises a first layer of material attached to a second layer of material, said tape reinforcement layer being disposed between said first and second layers of material.

13. The display package as defined in claim 11, wherein said display card comprises cardboard.

14. The display package as defined in claim 11, wherein the display card has a thickness substantially greater than a thickness of the tape reinforcement layer.

15. The display package as defined in claim 14, wherein said tape reinforcement layer has a thickness no greater than twenty-five percent of the thickness of the display card.

16. The display package as defined in claim 11, wherein said container houses one or more batteries.

17. The display package as defined in claim 11, wherein said container comprises a thermoformed blister of polymeric material.

18. The display package as defined in claim 11, wherein said tape reinforcement layer comprises a polypropylene film.

19. The display package as defined in claim 11 further comprising an adhesive located between the tape reinforcement layer and the main body of the display card for adhering the tape reinforcement layer to the main body.

20. The display package as defined in claim 11, wherein said tape reinforcement layer is disposed on the rear surface of the display card.

21. A battery package adapted to hang from a hanger and retain one or more batteries, said battery package comprising:

a container having a housing defining a compartment that is adapted to house one or more batteries;

one or more batteries housed in said compartment;

a display card having a main body and supporting said container, said main body including a front surface, a rear surface, and an edge;

a hanger hole formed in said display card to allow the display card to hang from a hanger; and a tape reinforcement layer formed adjacent to the hanger hold to provide increased strength between the hanger hole and the edge of the display card.

22. The battery package as defined in claim 21, wherein the hanger hole comprises a closed loop hanger hole spaced from the edge of the display card.

23. The battery package as defined in claim 21, wherein said display card comprises a first layer of material attached to a second layer of material, wherein said tape reinforcement layer is disposed between said first and second layers of material.

24. The battery package as defined in claim 21, wherein the display card has a thickness substantially greater than a thickness of the tape reinforcement layer.

25. The battery package as defined in claim 24, wherein said tape reinforcement layer has a thickness no greater than twenty-five percent of the thickness of the display card.

26. The battery package as defined in claim 21, wherein said display card comprises cardboard.

27. The battery package as defined in claim 21, wherein said tape reinforcement layer comprises a polypropylene film.

28. The battery package as defined in claim 21, wherein said container comprises a thermoformed blister of polymeric material.

29. The battery package as defined in claim 21 further comprising an adhesive located between the tape reinforcement layer and the main body of the display card for adhering the tape reinforcement layer to the main body.

* * * * *